United States Patent [19]

Risener et al.

[11] 4,353,675

[45] Oct. 12, 1982

[54] CASE AND CARTON HANDLING DEVICE

[76] Inventors: George W. Risener; R. V. Risener, both of 4014 Barcelona St., Tampa, Fla. 33609

[21] Appl. No.: 969,399

[22] Filed: Dec. 14, 1978

Related U.S. Application Data

[63] Continuation-in-part of Ser. No. 788,152, Apr. 18, 1977, abandoned.

[51] Int. Cl.[3] ..... B65B 21/02; B25J 11/00

[52] U.S. Cl. ..... 414/403; 414/419; 414/744 A; 414/758; 414/773

[58] Field of Search ..... 414/403, 404, 405, 419–422, 414/744 A, 744 B, 732, 736, 737, 738, 739, 740, 761–763, 773, 776, 589–590, 224–225; 198/404, 412, 377; 141/168

[56] References Cited

U.S. PATENT DOCUMENTS

| | | | |
|---|---|---|---|
| 1,958,846 | 5/1934 | Christensen | 414/773 X |
| 2,061,085 | 11/1936 | Price | 414/776 |
| 2,224,975 | 12/1946 | McNamara | 414/773 X |
| 2,259,728 | 10/1941 | Bridges | 414/758 X |
| 2,833,434 | 5/1958 | Stover et al. | 414/773 X |
| 3,327,878 | 6/1967 | Taylor | 414/773 X |
| 3,877,569 | 4/1975 | Shields | 414/776 |

*Primary Examiner*—Trygve M. Blix
*Assistant Examiner*—R. B. Johnson
*Attorney, Agent, or Firm*—Arthur W. Fisher, III

[57] ABSTRACT

A case and carton handling device to remove trash and debris from case and carton combinations and permit visual inspection thereof for damage. The case and carton handling device comprises a base with a drive shaft attached thereto, a case ring assembly to selectively engage the cases, remove them from a feed conveyor belt for inspection and return them to a discharge conveyor belt; and a carton ring assembly to selectively engage the cartons, remove them from the cases for inspection and return them to the cases. The case ring assembly includes a case ring positioner to position the case ring assembly at a first case ring position such that the case ring assembly may engage the cases and a second case ring position wherein the carton ring assembly may engage the cartons.

16 Claims, 8 Drawing Figures

CASE AND CARTON HANDLING DEVICE

CROSS REFERENCE TO RELATED APPLICATIONS

This application is a continuation-in-part to application Ser. No. 788,152, filed on Apr. 18, 1977 now abandoned.

BACKGROUND OF THE INVENTION

1. Field of the Invention

A case and carton handling device to remove trash and debris from case and carton combinations and permit inspection thereof for damage.

2. Description of the Prior Art

In the bottling industry, packaging is generally accomplished in cases or in case and carton combinations wherein a plurality of cartons are contained within a case. Upon return of the empty product receptacle and its removal to the production line, the case and carton must be cleaned and emptied of accumulated trash and debris and inspected for damage. This is a tedious task requiring many man-hours, much floor space and excessive handling.

Various packing devices now include checking means to determine proper sealing or weight. Also casing/bottle machines have been developed which include means to eject or reject defective casings or bottles. Specifically, these machines normally include various types of ejector arms or plates which remove the articles from the normal path of advance to either chutes or lateral conveyors. The following patents are typical of the prior art: U.S. Pat. No. 1,680,023; 1,958,846; 2,033,614; 2,224,975; 2,259,728; 2,485,040; 2,833,434; 3,011,633; 3,098,565; 3,127,721; 3,327,878; 3,452,508; 3,533,212; 3,590,550; 3,593,487; 3,599,391; 3,757,943; 3,874,144 and 3,956,110.

Unfortunately none of these devices provide means for removing accumulated trash and debris from case and carton combinations simply, efficiently, and economically. As a result, there is a long-felt need for a machine or device to accomplish these results.

SUMMARY OF THE INVENTION

The present invention relates to a case and carton handling device to remove trash and debris from case and carton combinations to permit the visual inspection thereof for damage. The case and carton handling device is disposed between a feed conveyor belt and a discharge conveyor belt so as to receive the case and carton combinations on one side and discharge them after the hereinafter operations have been performed on them on the opposite side.

The case and carton handling device includes a base means having a hollow drive shaft mounted thereon. A case ring assembly to selectively engage the cases, remove them from the feed conveyor belt, and return them to the discharge conveyor belt, and a carton ring assembly to selectively engage the cartons and remove them from the cases are operatively mounted on the drive shaft. The case ring assembly further includes a case ring positioning means. A main drive means is coupled to the drive shaft for rotation thereof.

The case ring assembly comprises a case ring plate mounted on the drive shaft and four case clamp assemblies attached at 90° intervals on the circumference thereof. Each case clamp assembly comprises a frame arm rotatably mounted to the case ring plate, a frame arm drive means, a clamp support member fixedly attached to the frame arm, and a pair of pressure plates. A clamping means is provided to selectively position the pair of pressure plates in a first position wherein the case is disengaged and a second position wherein the case is engaged.

The carton ring assembly is positioned above the case ring assembly and comprises a carton ring plate mounted on the drive shaft and four carton clamp assemblies attached at 90° intervals on the circumference thereof. Each carton clamp assembly comprises a frame tube rotatably mounted to the carton ring plate, a frame tube drive means, and at least one clamp tube positioned below the frame tube and operatively connected thereto by means of a flexible tube. The clamp tube has a plurality of apertures therein for air suction. Each of the frame tubes is operatively connected to a plenum chamber which is operatively connected to a blower means. The blower means operates to create a vacuum to provide a suction at each of the apertures for engaging the cartons. An air control valve is operatively disposed in each frame tube operable in either open position for engaging the cartons or closed position for disengaging the cartons.

The case ring positioning means comprises a jack cylinder and a jack drive means to selectively position the case ring assembly at a first ring position wherein the pressure plates may engage the cases and a second case ring position wherein the plurality of apertures may operatively engage the cartons.

A clutch is operatively mounted on the drive shaft to disengage the carton ring assembly while permitting continued operation of the case ring assembly for a case checking operation only.

In operation, the case and carton combination will approach the case and carton handling device on the feed conveyor belt. At a certain point, the clamping means will move the pressure plates to the second position thus engaging and clamping the case. A control switch will then operate the case ring positioning means to move the case ring assembly to the second case ring position. At this point, a control switch opens the air control valve means creating air flow and a suction against the cartons thus engaging and clamping the cartons. The case ring assembly is then lowered back to the first case ring position.

The main drive means is then operated to rotate the drive shaft and its case and carton ring assemblies 90°. While traveling through this arc, the case clamp assembly and the carton clamp assembly will be caused to rotate about the axes of the frame arm and frame tube respectively 180° thus turning both the case and the cartons upside down for inspection, self-emptying and/or replacement.

The case clamping and jacking operation will be accomplished again at this position as another case and carton combination is engaged by the next respective case clamp assembly.

Next, the case and carton assemblies are rotated another 90° while the case and carton clamp assemblies are again rotated 180°. At this point, the case and carton clamp assemblies are upright and 180° from the feed conveyor belt.

At this point, the jacking operation is again accomplished resulting in the cartons being replaced in the case. The air control valve means is now closed causing the cartons to be released. The jacking operation is again accomplished to lower the case and carton combination to the level of the discharge conveyor belt where the case is released by the pressure plates. The case with its carton is placed onto the discharge conveyor belt where they are then moved onto the product package loading line. The sequence of operation is then repeadted for each position thus creating a continuous process conveyor for handling and inspecting cases and cartons.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
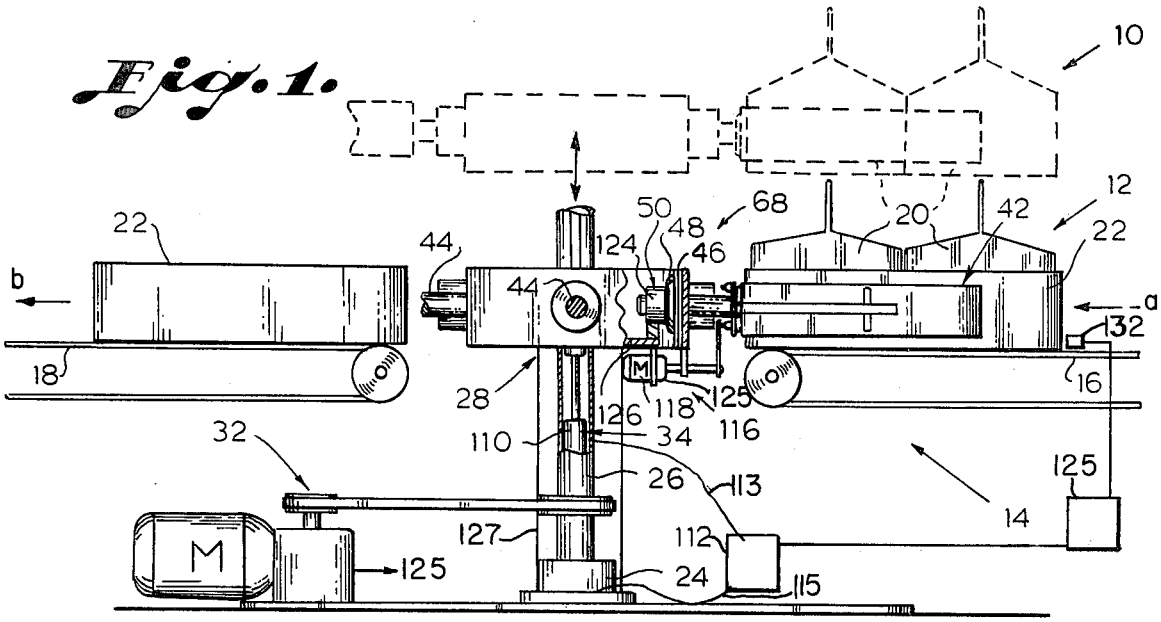
FIG. 1 is a front cross-sectional view of the case and carton handling device with the upper section of the drive shaft and the carton ring assembly removed and only one case clamp assembly shown.

As best shown in FIG. 1, the present invention relates to a case and carton handling device or checker generally indicated as 10 to remove trash and debris from case and carton combinations 12 and permit visual inspection thereof for damage. A conveyor means such as an endless belt generally indicated as 14 comprising a feed conveyor belt 16 and a discharge conveyor belt 18 is used in combination with the case and carton handling device 10 disposed therebetween. The handling device 10 receives the case and carton combinations 12 from the feed conveyor belt 16 as shown by arrow a and discharges them after performing the operations described hereinafter to the discharge conveyor belt 18 as shown by arrow b. Generally, the case and carton combinations 12 comprise cartons 20 for the containment of bottles such as soft drink bottles contained within cases 22 for the containment of several cartons 20.

Figure 2:
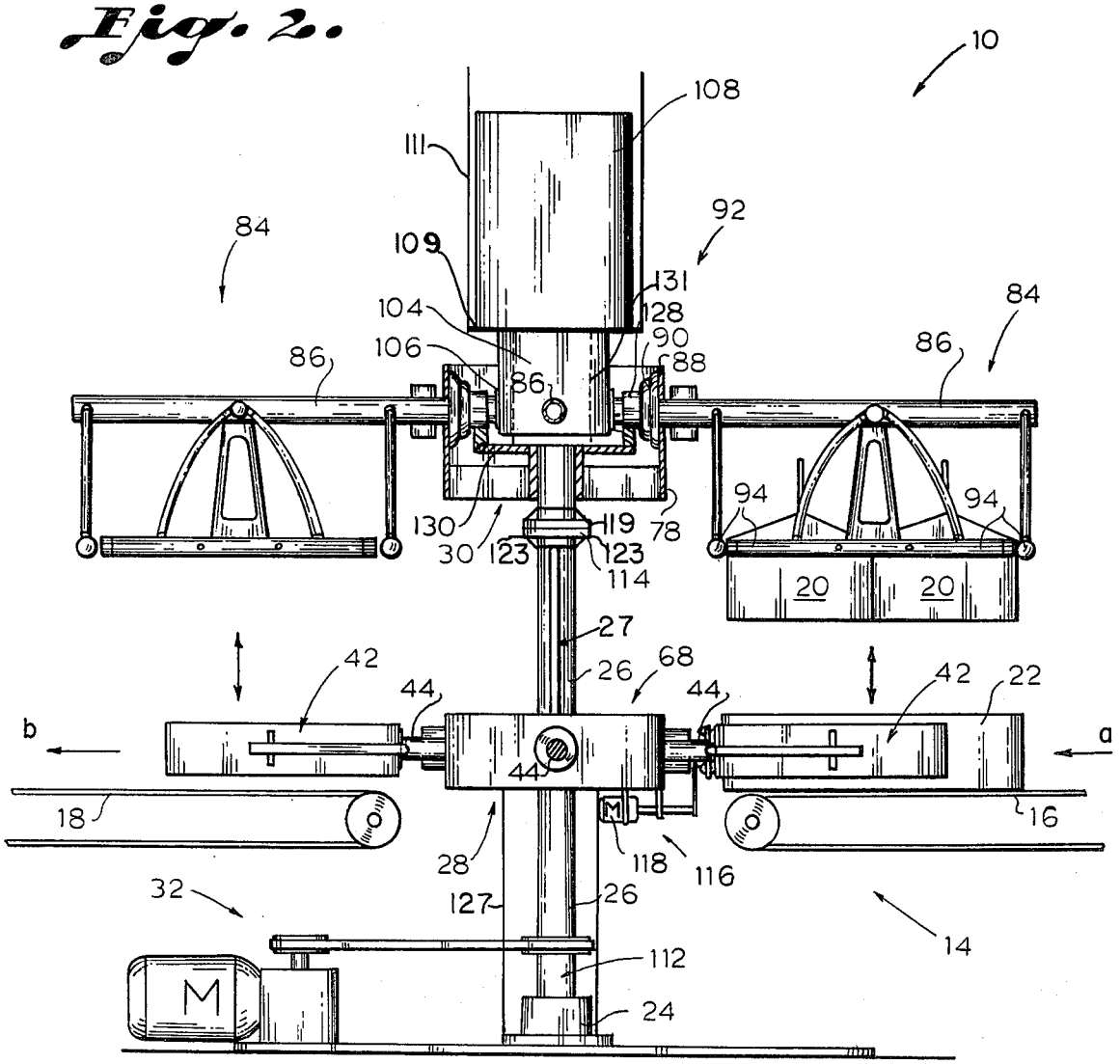
FIG. 2 is a front cross-sectional view of the case and carton handling device with the case clamp assemblies removed and only one carton clamp assembly fully shown.

As shown in FIGS. 1 and 2, the case and carton handling device 10 includes a base means 24 and a substantially vertical hollow drive shaft 26 including at least one substantially vertical slot 27 formed therein rotatably mounted on the base means 24. A case ring assembly 28 to selectively engage the cases 22, remove them from the feed conveyor belt 16 and return the cases 22 to the discharge conveyor belt 18, and a carton ring assembly 30 to selectively engage the cartons 20, remove them from the cases 22 and return them to the cases are operatively mounted on the drive shaft 26. A main drive means 32 such as a motor and gear or chain drive arrangement is coupled to the drive shaft 26 for rotation thereof at predetermined times as hereinafter described. The case ring assembly 28 further includes a case ring positioning means 34 such as a pneumatically controlled jack cylinder disposed within the drive shaft 26.

Figure 3:
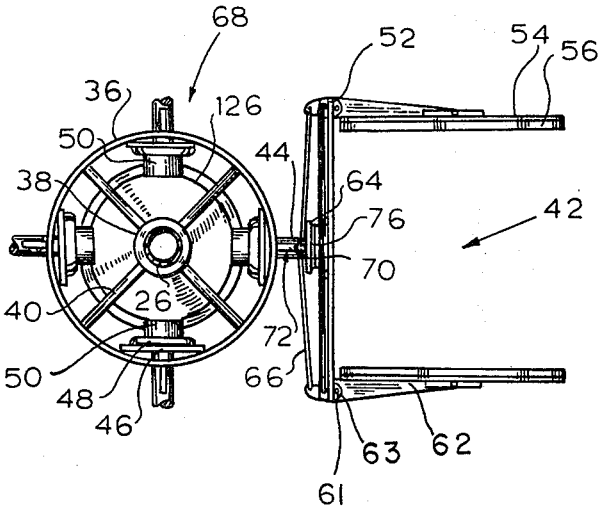
FIG. 3 is a top view of the case ring assembly with only one case clamp assembly shown.
Figure 4:
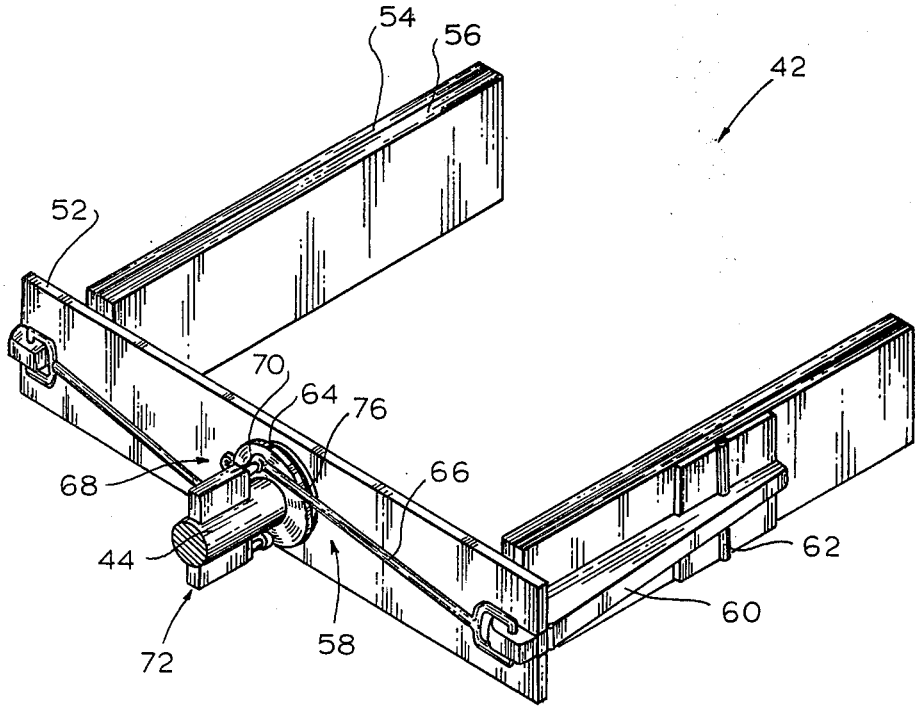
FIG. 4 is a detailed perspective view of a case clamp assembly.
Figure 7:
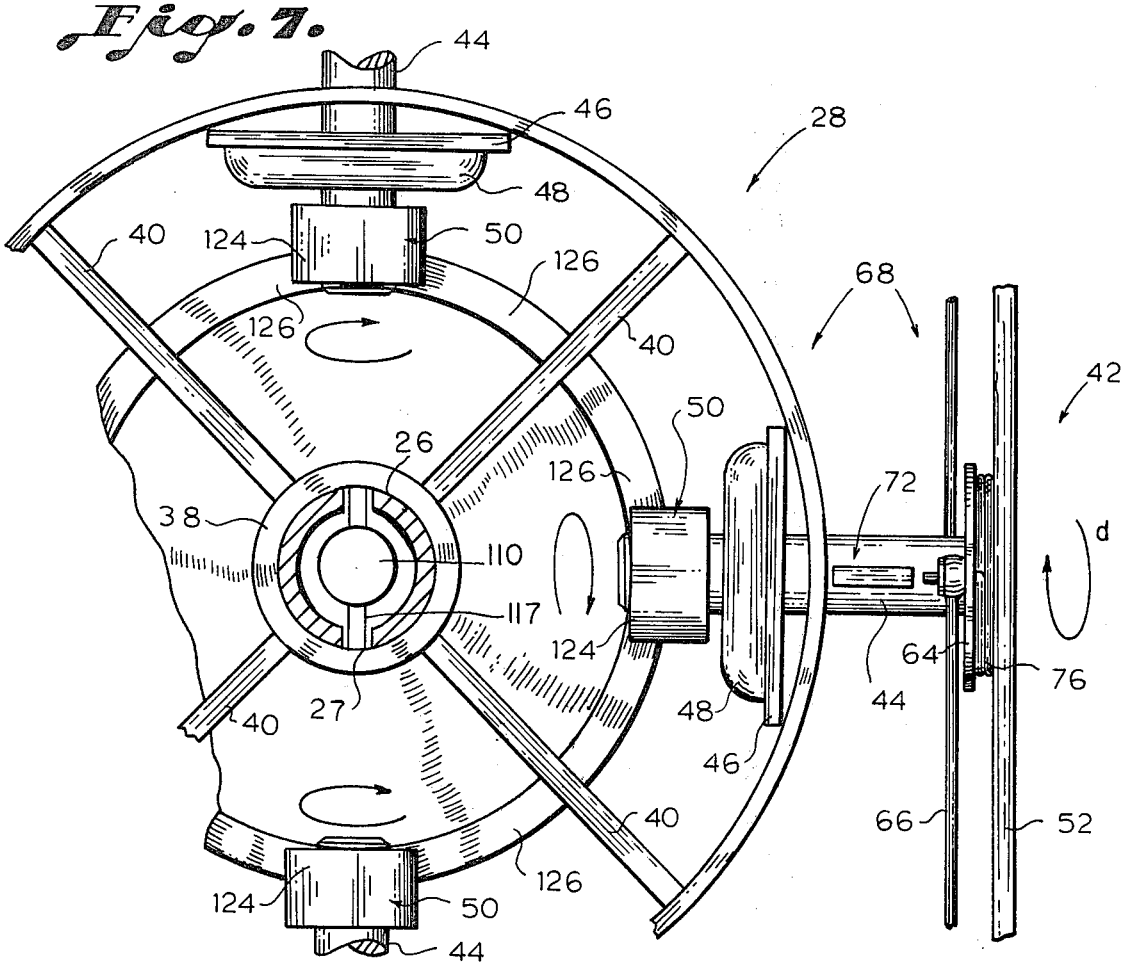
FIG. 7 is a detailed top view of the preferred frame arm drive means.
Figure 8:
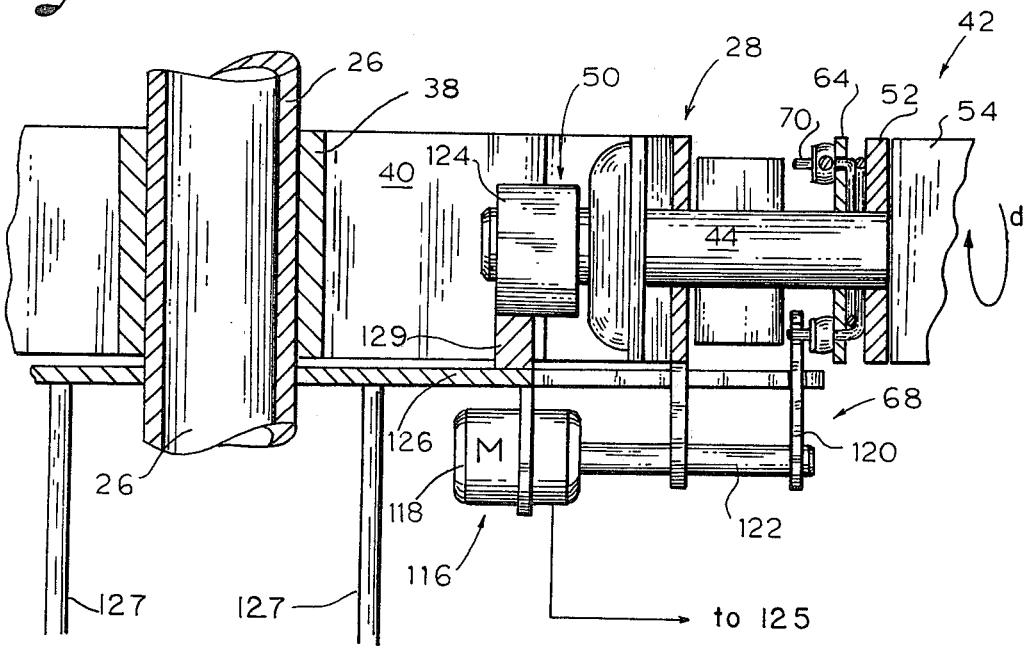
FIG. 8 is a detailed side view of the preferred positioner ring drive means and frame arm drive means.

As best shown in FIGS. 1 through 3, the case ring assembly 28 comprises a case ring plate 36 having a hub 38 and spoke supports 40. The case ring plate 36 is mounted on the drive shaft 26 at the hub 38. A plurality of four case clamp assemblies 42 are attached at 90° intervals along the circumference of the case ring plate 36. Each case clamp assembly 42 comprises a frame arm 44 rotatably mounted to the case ring plate 36 by means of a bearing plate 46, a bearing means 48, and a frame arm drive means 50, all positioned to the interior of the case ring plate 36. The preferred frame arm drive means 50 is best shown in FIGS. 7 and 8 and will be hereinafter described. As shown in FIGS. 3 and 4, a clamp support member 52, fixedly attached to the frame arm 44, supports a pair of pressure plates 54 each having a pressure pad 56 attached thereto to provide a cushioning effect. A clamping means 58 is provided to selectively position the pair of pressure plates 54 in a first position wherein the case 22 is disengaged and in a second position wherein the case 22 is engaged. The pressure pads 56 may be screwed or riveted to the pressure plates 54 for easy replacement.

The clamping means 58 comprises a pair of pressure arms 60 each hingedly connected to its respective pressure plate 54 at pin hinges 62 for positioning of the pair of pressure plates 54 under load, and at least partially engaged at the opposite end portions thereof by the respective end portions of the clamp support member 52 wherein the pressure arms 60 are movable only laterally so as to permit positioning of the clamping means 58 only between the first and second positions. Further pressure arms 60 are pivotally coupled to the clamp support member 52 by pins 61 extending through aperture formed in flanges 63 fixedly attached to the clamps support members 52. The clamping means further comprises a positioner ring 64, a pair of positioner levers 66 coupled between the pressure arms 60 and the positioner ring 64 so that the rotational movement of the positioner ring 64 as described more fully hereinafter will cause the pressure plates 54 to either move apart (toward first position) or toward each other (toward second position). The clamping means 58 further includes a positioner ring drive means 68 and positioner tabs 70 mounted on the positioner ring 64. A bias means 76 such as a spring is provided to return the pressure plates 54 to the first position. The positioner tabs 70 may comprise opposite ends of bias means 76 as shown. The bias means 76 is clamped between the positioner ring 64 and the clamp support member 52. The preferred positioner ring drive means 68 is best shown in FIGS. 7 and 8 and will be hereinafter described.

Figure 5:
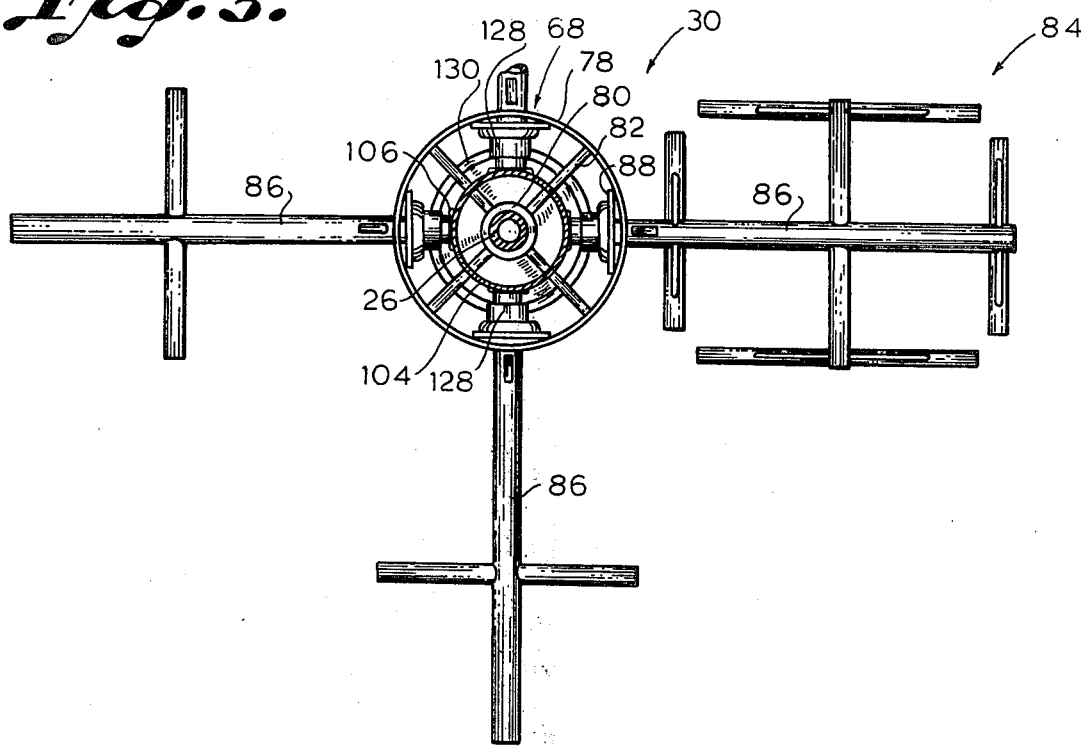
FIG. 5 is a top view of a carton ring assembly with one carton clamp assembly fully shown.
Figure 6:
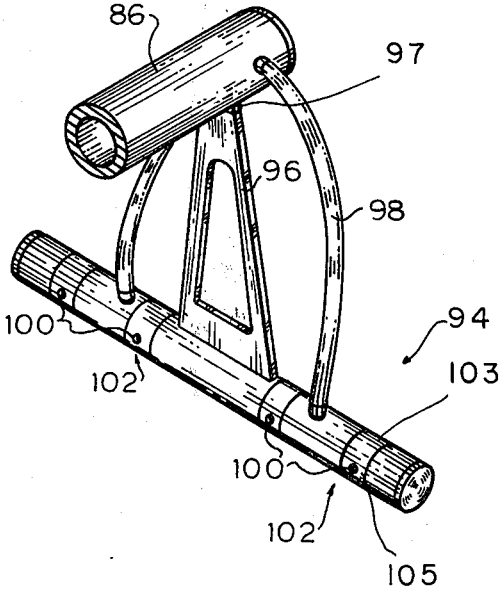
FIG. 6 is a detailed perspective view of a carton clamp assembly.

As shown in FIGS. 2, 5 and 6, the carton ring assembly 30 is positioned above the case ring assembly 28 and comprises a carton ring plate 78 having a hub 80 interconnected by spoke supports 82. The carton ring plate 78 is mounted on the upper portion of the drive shaft 26 at the hub 80. A plurality of four carton clamp assemblies 84 are attached at 90° intervals on the circumference of the ring plate 78. Each carton clamp assembly 84 comprises a frame tube 86 rotatably mounted to the carton ring plate 78 by means of a bearing plate 88, a bearing means 90 and a frame tube drive means 92, which will be hereinafter described, positioned on the interior of the ring plate 78 and at least one clamp tube 94 positioned below the frame tube 86.

Brackets 96, hinged to frame tube 86 by hinge 97, and interconnecting flexible tubes 98 operatively interconnect the clamp tubes 94 with the frame tube 86 such that the pressure in the clamp tubes 94 is substantially equal to the pressure in the frame tube 86 to permit the clamp tubes 94 to engage the sides of cartons 20 when the suction is generated within the frame tube 86 and clamp tubes 94 as more fully described hereinafter. The end portions of the clamp tubes 94 are capped. The clamp tube 94 has a plurality of apertures 100 therein for air suction and an air control means 102 such as a rotatably mounted ring 103 including an aperture 105 to selectively (manually) close or open for each corresponding aperture 100. Centrally disposed above the hub 80 is a plenum chamber 104 operatively coupled to each of the frame tubes 86. An air control valve means 106 movable between an open and closed position such as a flapper valve (not shown) is operatively disposed in each frame tube 86 operable in either open position for engaging the cartons 20 or closed position for disengaging the cartons 20. The opposite ends of the frame tubes 86 are capped. A blower means 108 driven by a blower drive means (not shown) such as a motor, is operatively connected to the plenum chamber 104. The blower 108 operates to create a vacuum to provide a suction at each of the apertures 100. As best shown in FIG. 2, the blower 108 is held in a fixed position by support member comprising a substantially horizontal support element 109 and a pair of substantially vertical support elements 111.

As shown in FIG. 1, the case ring positioning means 34 comprises a jack cylinder or piston 110 disposed within the drive shaft 26 below the case ring assembly 28 coupled to hydraulic or pneumatic power means 112 by feed and return conduits 113 and 115 to selectively move the jack cylinder 110 between an upper and lower position as shown by arrow c to position the case ring assembly 28 at a first cast ring position wherein the pressure plates 54 may engage the cases 22 and at a second case ring position wherein the plurality of apertures 100 may operatively engage the cartons 20. As shown in FIG. 7, the jack cylinder 110 is coupled to the case ring assembly hub 38 by suitable mechanical means such as a rod 117 extending through the substantially vertical slots 27 formed in the hollow drive shaft 26.

A clutch means such as a mechanical clutch 114 including upper and lower clutch elements 119 and 121 disposed to operatively engage and disengage by lever 123 is operatively mounted on the drive shaft 26 between the case ring assembly 28 and the carton ring assembly 30 to disengage the carton ring assembly 30 while permitting continued operation of the case ring assembly for a case checking operation only.

Control of the jack drive means 112, the main drive means 32, and other drive means is accomplished by the use of a control system including mechanical trips, limit switches, photocells, and other items installed as generally done in the art pertaining to such control systems examples of which are more fully described hereinafter.

A master control panel 125 may also be located at the operator's station (not shown). The control panel 125 may comprise necessary logic circuitry including timing control such as a printed circuit board or the like to provide operational control and sequencing.

FIGS. 7 and 8 best show the details of the frame arm drive means 50 as well as the positioner ring drive means 68. The positioner ring drive means 68 comprises a control means 116 such as a two directional control motor 118 coupled to panel 125 having a control lever 120 attached thereto by control shaft 122. The control lever 120 is disposed in operative engagement with positioner tab 70 to release tension in the pressure plates 54 when the control motor 118 is operated in the first direction and permit spring 76 to move the pressure plates 54 toward each other pivoting about pin 61 to the second (engage) position when operated in the second direction.

The frame arm drive means 50 comprises a wheel or tire 124 fixedly affixed to the inner portion of frame arm 44 and disposed to engage stationary friction plate 126 supported by vertical supports 127 such that as the case ring assembly 28 is rotated about drive shaft 26, the friction therebetween causes the tire 124 and frame arm 44 to rotate about its horizontal axis in a counter-clockwise direction as shown by arrow d at a predetermined rate proportional to the rate of rotation of the case ring assembly 28 about the vertical axis of the drive shaft 26. The frame arm drive means 50 may include a plurality of teeth 135 formed about the periphery of the wheel 124 and a plurality of teeth 129 formed on the friction plate 126 along the path of travel of the wheel 124 thereon to engage the teeth of the wheel 124 for improvement of frictional engagement therebetween.

The frame tube drive means 92 is constructed and operates in substantially the same manner as just described for the frame arm drive means, the wheel and stationary friction plate being indicated as 128 and 130 respectively in FIG. 5. The stationary friction plate 130 is coupled to the supporting member 109 of the blower through substantially vertical interconnecting member 131 coupled thereto.

In operation, a case and carton combination 12 will approach the case and carton handling device 10 on the feed conveyor belt 16. A switch or photocell 132 coupled to panel 125 will control the conveyor belt 16 advance and allow only one case 22 to enter the case ring assembly 28. Simultaneously, the positioner ring drive means 68 causes the control motor 118 to operate in the first direction forcing control lever 120 into operative engagement with the positioner tab 70 causing the positioner ring 64 to rotate and move the pressure plates 54 apart permitting the case 22 to enter therebetween. Once the case 22 has passed sensor or switch 132 the conveyor 16 is stopped and motor 118 reverses permitting plates 54 to engage case 22 under the influence of bias 76.

The jack drive means 112 coupled to panel 125 to cause the jack cylinder 110 to move the case ring assembly 28 upwards from the first to the second case ring position. At this point, the air control valve means 106 coupled to panel 125 is opened, the blower means 108 constantly operating, creating air flow and a suction through the carton clamp assembly 84 and against the cartons 20 thus engaging and clamping the cartons 20. The jack drive means 112 is again operated to lower the case ring assembly 28 back to the first case ring position through control of panel 125.

The control panel 125 then operates the main drive means 32 to rotate the drive shaft 26 and the case and carton ring assemblies 28 and 30 respectively 90°. While traveling through this arc, the case clamp assembly 42 and the carton clamp assembly 84 will rotate about the axes of the fram arm 44 and frame tube 86 respectively 180° thus turning both the case 22 and the carton 20 upside down for inspection, self-emptying, and/or replacement.

The case clamping and jacking operation will be accomplished again at this position as another case and carton combination 12 is engaged by the next respective case clamp assembly 42.

Next the control panel 125 will again operate the main drive means 32 to engage the drive shaft 26 for another 90° rotation of the case and carton ring assembly 28 and 30 respectively. Meanwhile, the case clamp assembly 42 and the carton clamp assembly 84 will again be caused to rotate 180°. At this point the case clamp assembly 42 and the carton clamp assembly 84 are upright and 180° from the feed conveyor belt 16.

At this point, the jacking operation is again accomplished resulting in the cartons 20 being replaced in the case 22. The air control means 106 is now closed under control of panel 125 causing the cartons 20 to be released. The jacking operation is again accomplished to lower the case and carton combination 12 to the level of the discharge conveyor belt 18 where the case 22 is released by the pressure plates 54. The case 22 with its cartons 20 then falls onto the discharge conveyor belt 18 where they are then moved onto the product package loading line.

The control system will now engage the drive shaft 26 and the various drive means to follow the same sequence of operation for each position, thus creating a continuous process conveyor for handling and inspecting cases and cartons.

If the carton operation is not required, the carton ring assembly 30 can be disengaged by operating the clutch means 114 by operatively disengagement of 119 and 121 by lever 123 and just operating the case ring assembly 28. In this case, the jacking operation wouldnot be required.

Each assembly may be fed in series as they advance at 90° increments. As such the conveyor 16 will be selectively controlled by panel 125.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also understood that the following claims are intended to cover all of the generic and specific features of the invention herein described, and all statements of the scope of the invention which, as a matter of language, might be said to fall therebetween.

Now that the invention has been described,

What is claimed is:

1. A case and carton handling device for the removal of trash and debris from case and carton combination and visual inspection thereof wherein a plurality of cartons is contained within the case, said case and carton handling device comprising a base means having a substantially vertically disposed drive shaft extending upwardly therefrom, a main drive means, said drive shaft being operatively coupled to said main drive means mounted on said base means, a case ring assembly including at least one case clamp assembly operatively mounted on said drive shaft to selectively engage the cases, a carton ring assembly including at least one carton clamp assembly operatively mounted on said drive shaft above said case ring assembly and a conveyor means including a feed conveyor belt to deliver the case and carton combination to said case ring assembly and a discharge conveyor belt to discharge the case and carton combinations, said drive shaft rotatably mounted on said base means to move said case ring assembly and said carton ring assembly between said feed conveyor belt and said discharge conveyor belt, and a case ring positioning means movable between a first and second position to move said case ring assembly upward relative to said carton ring assembly such that when in said first position said case ring assembly engages the case to remove the case from said feed conveyor belt and when in said second position the plurality of cartons is operatively engaged by said carton ring assembly to remove said plurality of cartons from the case, said case means coupling ring assembly to said drive shaft to transport the case from said feed conveyor belt to said discharge conveyor belt in response to rotation of said drive shaft, said case clamp assembly being rotated in the horizontal plane as said drive shaft rotates so that trash and debris contained therein is gravitationally removed therefrom and said carton ring assembly being coupled to said drive shaft to transport the case, from said feed conveyor belt to said discharge conveyor belt as said drive shaft rotates said carton clamp assembly being rotated in the horizontal plane as said drive shaft rotates so that trash and debris contained therein is gravitationally removed therefrom and that as said drive shaft moves said case ring assembly and said carton ring assembly into operative relationship relative to said discharge conveyor belt, said case ring positioning means moves from said first to said second position to return the cartons to the case and to said first position to place the case and carton combinations on said discharge conveyor belt.

2. The case and carton handling device of claim 1 wherein said case ring assembly comprises a case ring plate mounted on said drive shaft and at least one case clamp assembly attached to said case ring plate, said case clamp assembly comprises a frame arm rotatably mounted to said ring plate, a clamp support member fixedly attached to the frame arm, a pair of pressure plates, a clamping means to selectively position said pair of pressure plates in a first position wherein the case is disengaged and in a second position wherein the case is engaged, and a frame arm drive means to rotate said frame arm so that the case is rotated when said pair of pressure plates are in said second position.

3. The case and carton handling device of claim 2 wherein said main drive rotates said drive shaft such that said frame arm drive means rotates the case substantially 360° about a substantially horizontal axis while said main drive means rotates said case clamp assembly substantially 180° about the vertical axis of said drive shaft so as to permit the discharge of the case onto the discharge conveyor belt.

4. The case and carton handling device of claim 2 wherein said clamping means comprises a pair of pressure arms each hingedly connected to its respective pressure plate on one end portion and at least partially engaged at the other end portion thereof by the respective end portion of said clamp support member wherein said pair of pressure arms are movable laterally to permit positioning of said clamping means between said first and second positions, a positioner ring rotatable about said frame arm between said first and second positions, a pair of positioner levers pivotally attached on one end portion to said respective pressure arms and on the opposite end portion thereof to the positioner ring, each said positioner lever attached to said positioner ring on opposite sides of said frame arm so that the rotational movement of said positioner ring will position said pressure plates between said first and second positions, said clamping means further comprises a positioner ring drive means to move said pair of pressure plates to said first position and a biasing means coupled to said positioner ring to return said pair of pressure plates to said second position.

5. The case and carton handling device of claim 4 wherein said positioner ring drive means comprises a control means operable in a first and second direction, said control means comprises a two-directional motor including a control shaft and a control lever attached to said control shaft, said control lever attached to said control shaft, said control lever operatively engages said biasing means to release tension in said pressure plates when said control motor operates in said first direction and to permit said biasing means to move said pressure plates to said second clamping position when said control motor operates in said second direction.

6. The case and carton handling device of claim 1 wherein said carton ring assembly comprises a frame tube drive means to rotate the cartons substantially 360° about a substantially horizontal axis while said main drive means rotates said carton ring assembly and said case ring assembly substantially 180° about the vertical axis to said drive shaft to permit return of the plurality of cartons to the case and to permit discharge of the case into said discharge conveyor belt.

7. The case and carton handling device of claim 6 wherein said frame tube drive means comprises a stationary friction plate and a wheel fixedly affixed to said frame tube and disposed to engage said stationary friction plate such that as said carton ring assembly is rotated with said drive shaft, the friction between said stationary friction plate and said wheel cause said wheel and said frame tube to rotate about the horizontal axis of said wheel and said frame tube at a predetermined rate proportional to the rate of rotation of said carton ring assembly about the vertical axis of said drive shaft.

8. The case and carton handling device of claim 6 wherein said case ring assembly comprises a case ring plate mounted on said drive shaft and at least one case clamp assembly attached to said case ring plate, said carton ring assembly comprises a carton ring plate mounted on said drive shaft and a carton clamp assembly attached to said carton ring plate and disposed to engage said plurality of cartons at said second case ring position.

9. The case and carton handling device of claim 8 wherein said carton clamp assembly comprises at least one clamp tube having a plurality of apertures therein, a frame tube rotatably mounted on said carton ring plate and operatively engaged with said clamp tube such that the pressure in said clamp tube is substantially equal to the pressure in said frame tube and a blower means operatively engaged with said frame tube to create a vacuum to provide a suction at said plurality of apertures, said plurality of apertures disposed substantially adjacent to the plurality of cartons when said case clamp assembly is at said second case ring position so that said suction causes said carton clamp assembly to engage the plurality of cartons.

10. The case and carton handling device of claim 9 wherein said carton clamp assembly further includes an air control means for each said aperture, at least one flexible tube operatively interconnects said clamp tube with said frame tube and a bracket hingedly connects said clamp tube with said frame tube, such that flexible yet sturdy means for movement of said clamp tube is provided.

11. The case and carton handling device of claim 10 wherein said carton clamp assembly further includes an air control valve means operable in an open and a closed position and operatively disposed between said blower means and said clamp tube, said air control valve means is positioned in said open position for engagement of the plurality of cartons and in said closed position for disengagement of the plurality of cartons.

12. The case and carton handling device of claim 11 wherein said case clamp assembly comprises a frame arm rotatably mounted to said ring plate, a clamp support member fixedly attached to the frame arm, a pair of pressure plates, a clamping means to selectively position said pair of pressure plates in a first clamping position wherein the case is disengaged and in a second clamping position wherein the case is engaged, and a frame arm drive means to rotate said frame arm so that the case is rotated substantially 360° when said pair of pressure plates are in said second clamping position.

13. The case and carton handling device of claim 12 wherein said clamping means comprises a pair of pressure arms each hingedly connected to its respective pressure plate on one end portion and at least partially engaged at the other end portion thereof by the respective end portion of said clamp support member wherein said pair of pressure arms are movable laterally to permit positioning of said clamping means between said first and second clamping positions, a positioner ring rotatable about said frame arm between said first and second clamping positions a pair of positioner levers pivotally attached at one end portion thereof to the positioner ring, each said positioner lever attached to said positioner ring on opposite sides of said frame arm so that the rotational movement of said positioner ring will position said pressure plates between said first and second clamping positions, said clamping means further comprises a positioner ring drive means to move said pair of pressure plates to said second clamping position and a biasing means to return said pair of pressure plates to said first clamping position.

14. The case and carton handling device of claim 2 wherein said frame arm drive means comprises a stationary friction plate and a wheel fixedly affixed to said frame arm, said wheel disposed to rest on said stationary friction plate such that as said case ring assembly is rotated about said drive shaft, the friction between said stationary friction plate and said wheel causes said wheel and said frame arm to rotate about the horizontal axis of said wheel and said frame arm at a predetermined rate proportional to the rate of rotation of said case ring assembly about the vertical axis of said drive shaft.

15. The case and carton handling device of claim 14 wherein said wheel includes a plurality of teeth formed about the periphery thereof, said stationary friction plate includes a plurality of teeth formed thereon along at least a portion of the path of travel of said wheel wherein said plurality of teeth formed on said wheel engage said plurality of teeth formed on said stationary friction plate for improvement of frictional engagement therebetween.

16. The case and carton handling device of claim 8 wherein said frame tube drive means comprises a stationary friction plate and a wheel fixedly affixed to said frame tube, said wheel disposed to rest on said stationary friction plate such that as said carton ring assembly is rotated about said drive shaft, the friction between said stationary friction plate and said wheel cause said wheel and said frame tube to rotate about the horizontal axis of said wheel and said frame tube to rotate about the horizontal axis of said wheel and said frame tube to rotate about the horizontal axis of said wheel and said frame tube at a predetermined rate proportional to the rate of rotation of said carton ring assembly about the vertical axis of said drive shaft, said wheel includes a plurality of teeth formed about the periphery thereof, said stationary friction plate includes a plurality of teeth formed thereon along at least a portion of the path of travel of said wheel wherein said plurality of teeth formed on said wheel engage said plurality of teeth formed on said stationary friction plate for improvement of frictional engagement therebetween.

* * * * *